US006434354B2

(12) United States Patent
Bisaiji

(10) Patent No.: US 6,434,354 B2
(45) **Date of Patent: *Aug. 13, 2002**

(54) IMAGE FORMING APPARATUS

(75) Inventor: Takashi Bisaiji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/793,542

(22) Filed: Feb. 27, 2001

Related U.S. Application Data

(63) Continuation of application No. 09/458,810, filed on Dec. 10, 1999, which is a continuation of application No. 09/126,951, filed on Jul. 31, 1998, now Pat. No. 6,091,922.

(30) Foreign Application Priority Data

Aug. 2, 1997 (JP) ..... 9-221006

(51) Int. Cl.[7] ..... G03G 15/01; G03G 15/16

(52) U.S. Cl. ..... 399/296; 399/297; 399/302

(58) Field of Search ..... 399/2, 3, 4, 296, 399/297, 298, 301, 302, 366; 430/47, 126; 358/526, 530; 283/902

(56) References Cited

U.S. PATENT DOCUMENTS

| | | | | | |
|---|---|---|---|---|---|
| 5,158,852 | A | * | 10/1992 | Sakata et al. | 430/126 X |
| 5,737,677 | A | * | 4/1998 | Tombs et al. | 399/296 |
| 5,799,235 | A | * | 8/1998 | Nakano et al. | 399/302 |
| 5,887,218 | A | | 3/1999 | Yuu et al. | |
| 6,091,922 | A | * | 7/2000 | Bisaiji | 399/297 |
| 6,259,879 | B1 | * | 7/2001 | Bisaiji | 399/296 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus of the type sequentially forming toner images of different colors on an image carrier while sequentially transferring them to an intermediate transfer body one above the other, and then transferring the resulting composite toner image from the intermediate transfer body to a paper or similar recording medium. Dot toner images different from desired toner images are formed on the image carrier. The dot toner images are transferred from the image carrier to the intermediate transfer body and then to the recording medium. The individual toner images are transferred from the image carrier to the intermediate transfer body in accurate register with each other.

12 Claims, 4 Drawing Sheets

IMAGE FORMING APPARATUS

This application is a continuation of application Ser. No. 09/458,810 filed on Dec. 10, 1999, which is a continuation of Ser. No. 09/126,951, filed Jul. 31, 1998, now U.S. Pat. No. 6,091,922.

BACKGROUND OF THE INVENTION

I. Field of the Invention

The present invention relates to an image forming apparatus of the type forming a toner image on an image carrier, then transferring the toner image to an intermediate transfer body (primary transfer hereinafter), and then transferring the toner image to a paper or similar recording medium (secondary transfer hereinafter).

II. Discussion of the Background

An image forming apparatus of the type described is conventional. I conducted a series of researches and experiments with such an image forming apparatus in order to further enhance the quality of the toner image finally transferred to a recording medium. The researches and experiments showed that at the time of the primary transfer of a toner image, the linear velocity of the surface of an image carrier and that of the surface of an intermediate transfer body sharply change and cause the image to be dislocated on the intermediate transfer body. This problem is particularly serious with a color image forming apparatus which sequentially forms toner images of different colors on an image carrier while sequentially transferring them from the image carrier to an intermediate transfer body one above the other; the dislocation of the individual toner images on the intermediate transfer body critically deteriorates the quality of the final image transferred to a recording medium.

SUMMARY OF THE INVENTION

It is therefore an object of the present invention to provide an image forming apparatus capable of insuring a high quality image by reducing the dislocation of an image.

In accordance with the present invention, an image forming apparatus includes an image carrier for forming a toner image on its surface thereof. An intermediate transfer body has a surface to which the toner image is transferred from the surface of the image carrier by primary transfer. A first electric field forming member forms between the image carrier and the intermediate transfer body a static electric field for effecting the primary transfer of the toner image. A second electric field forming member forms between the intermediate transfer body and a recording medium a static electric field for transferring the toner image from the surface of the intermediate transfer body to the recording medium. A dot image forming device forms a number of scattered dot toner images in the form of fine dots on the surface of the image carrier. The dot toner images are transferred from the surface of the image carrier to the image area of the intermediate transfer body.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
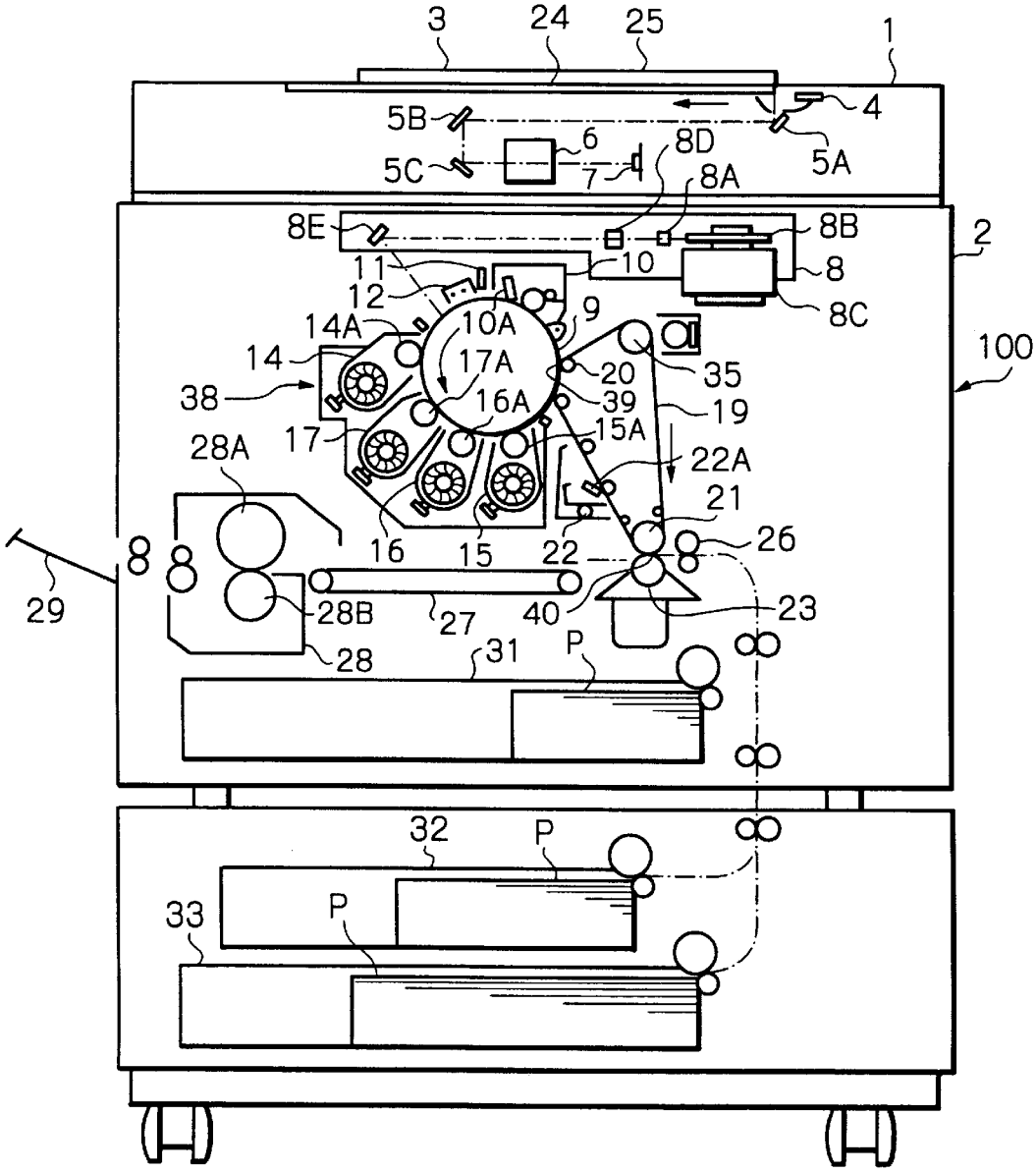
FIG. 1 is a section showing the general construction of an image forming apparatus embodying the present invention.

Referring to FIG. 1 of the drawings, an image forming apparatus embodying the present invention is shown and generally designated by the reference numeral 100. As shown, the apparatus 100 is implemented as a color image forming apparatus by way of example and includes a color scanner or image reading unit 1 and a color printer 2 arranged below the color scanner 1. The color scanner 1 includes a glass platen 24 mounted on the top of its casing. A document 3 is laid on the glass platen 24 and pressed by a cover plate 25 from above. While a lamp 4 disposed in the above casing is moved to sequentially scan the document 3 in a direction indicated by an arrow, the resulting imagewise reflection from the document 3 is incident to a color image sensor 7 via mirrors 5A, 5B and 5C and a lens 6. The mirrors 5A–5C are also movable. The image sensor 7 reads incident color information color by color, e.g., blue (B), green (G) and red (R) information, and transforms them to corresponding electric image signals. For this purpose, the image sensor 7 includes BGR color separating means and CCDs (Charge Coupled Devices) or similar photoelectric transducing means. While the image sensor usually outputs BGR image data as a result of three consecutive times of scanning of the document 3, it may be constructed to output such data as a result of one time of scanning.

Figure 2:
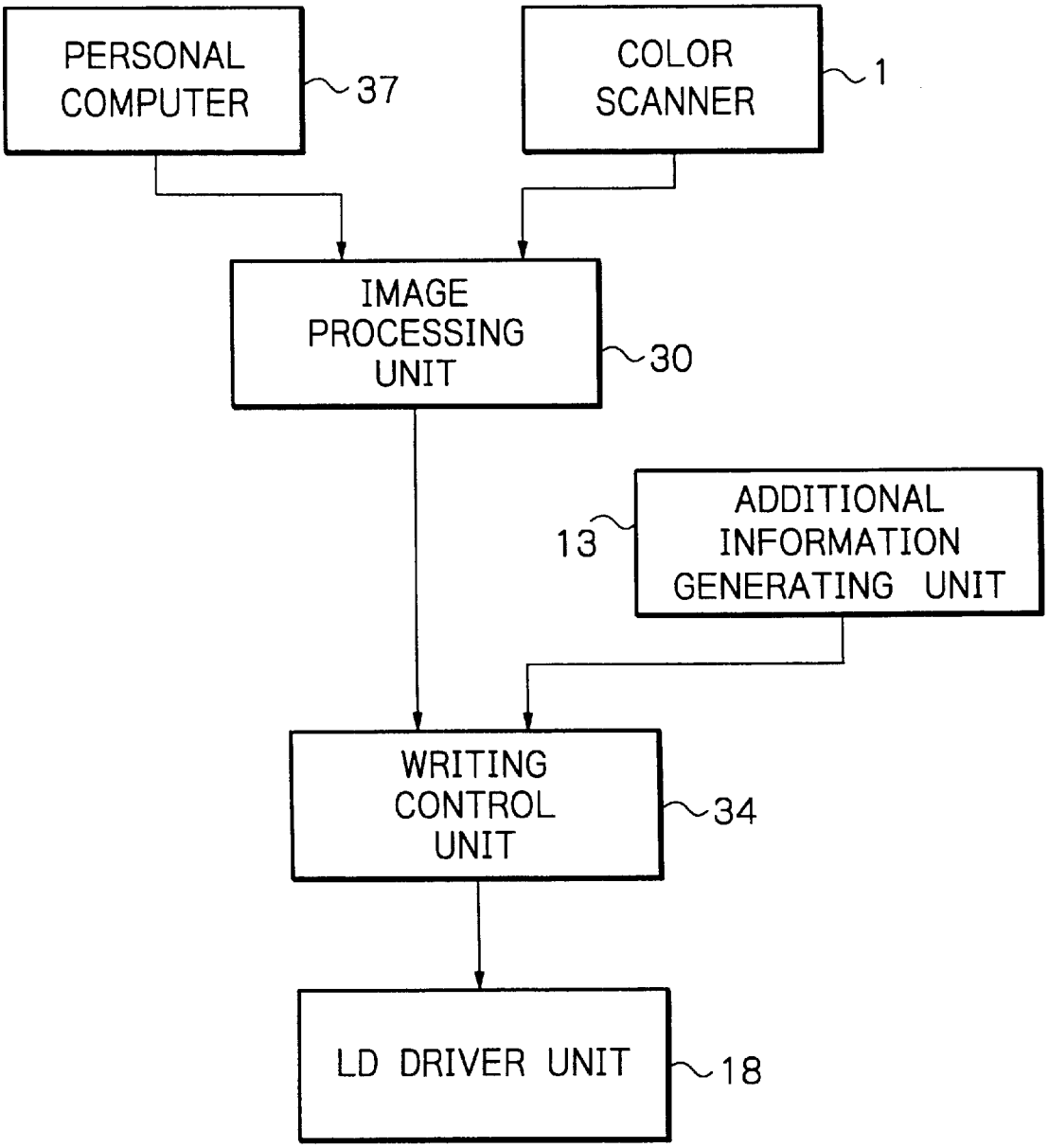
FIG. 2 is a block diagram schematically showing a control system included in the illustrative embodiment.
Figure 3:
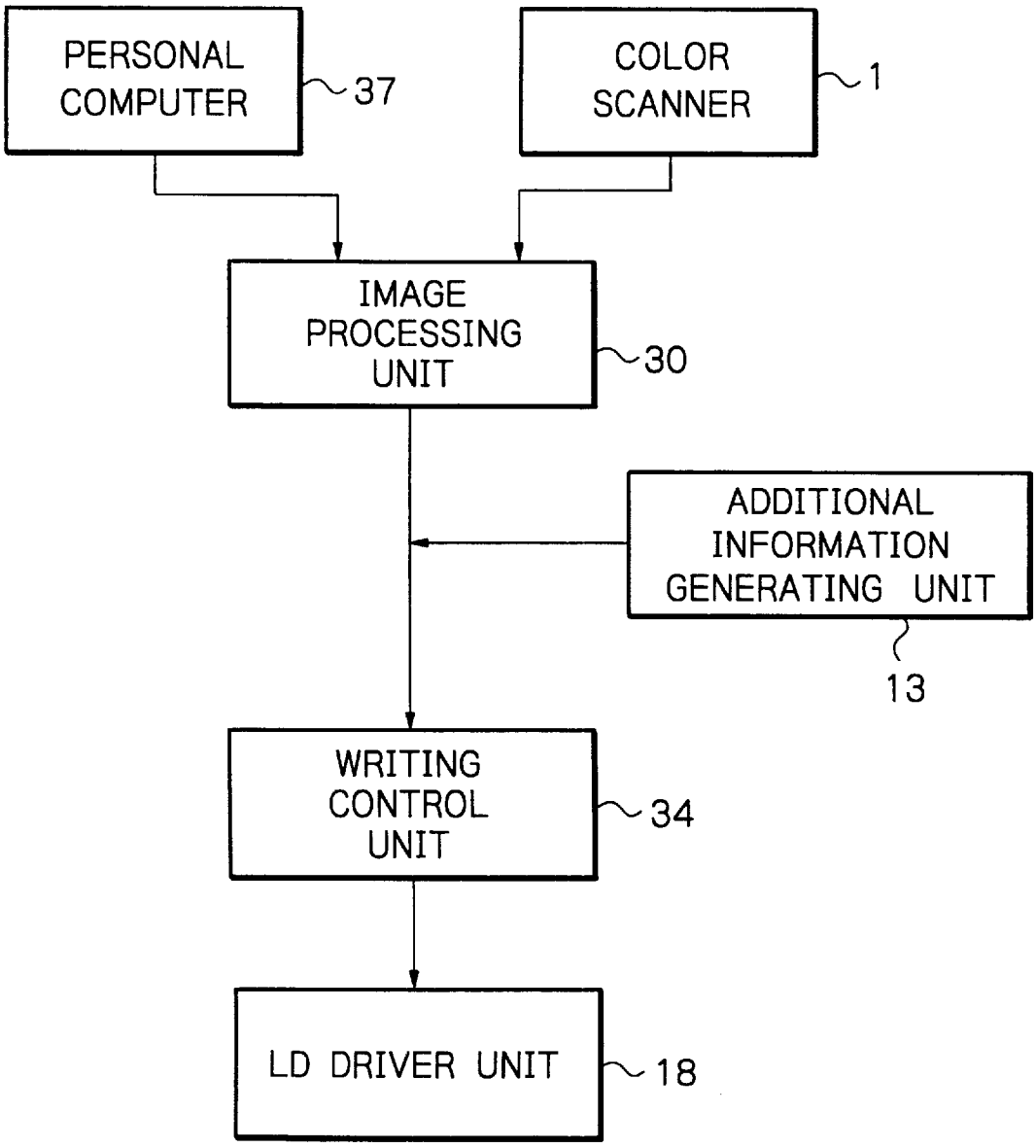
FIG. 3 is a schematic block diagram showing an alternative control system included in the illustrative embodiment.

As shown in FIGS. 2 and 3, the BGR image data are fed from the image sensor 7 to an image processing unit 30. The image processing unit 30 processes the BGR image data in accordance with their signal strength levels and thereby transforms them to black (B), cyan (C), magenta (M) and yellow (Y) image data. The BCMY image data are input to a control unit 34 performing tonality processing and other preselected processing. To produce the BCMY image data, the color scanner 1 causes its lamp 4 and mirrors 5A–5C to move, as stated with reference to FIG. 1, in response to a scanner start signal synchronous with the operation of the color printer 2. Every time the lamp 4 and mirrors 5A–5C are moved, one of the RGB image data is output.

As also shown in FIGS. 2 and 3, the RGB image data output from the color scanner 1 may be replaced with RGB image data output from a personal computer 37, if desired.

Referring again to FIG. 1, a photoconductive element 9 implemented as a drum is rotatably mounted on a frame, not shown, included in the color printer 2. The drum 9 is rotatable counterclockwise about its axis, as viewed in FIG. 1. While the drum 9 is in rotation, its surface is discharged by a discharge lamp or discharger 11 and then uniformly charged by a charger 12 to a preselected polarity (negative polarity in the illustrative embodiment). An optical writing unit 8, which is a specific form of an exposing device, exposes the charged surface of the drum 9 imagewise and thereby electrostatically forms a latent image on the drum 9.

The optical writing unit 8 includes a laser 8A and a control section for controlling the drive of the laser 8A. FIGS. 2 and 3 show an LD (Laser Diode) drive unit 18 representative of the above control section. A writing control unit 34 shown in FIGS. 2 and 3 processes the BCMY image data as data for turning on and turning off the laser 8A. As a result, the laser 8A issues a laser beam in accordance with the processed data. The laser beam scans the drum 9 in order to form the latent image.

Specifically, the laser beam issuing from the laser 8A is steered by a polygonal mirror 8B being rotated by a motor 8C. The laser beam from the polygonal mirror 8B is routed through an f-θ lens 8D and a mirror 8E to the uniformly charged surface of the drum 9. The surface potential of the drum 9 drops in a portion scanned by the laser beam, forming an image portion or latent image. The surface potential of the drum substantially does not drop in the other portion not scanned by the laser beam, forming a background. Consequently, the latent image is formed on the drum 9 in accordance with the image data. The writing unit 8 transforms the color image data output from the color scanner 1 or the personal computer 37 to an optical signal and forms the latent image on the drum 9 in accordance with the optical signal.

Latent images respectively derived from the B, C, M and Y image data are sequentially formed on the drum 9. Such latent images each is developed by a preselected one of developing units 14, 15, 16 and 17 arranged around the drum 9. As a result, the latent images each turns out a toner image of particular color.

In the illustrative embodiment, the developing units 14–17 are assumed to respectively store a B toner and carrier mixture, a C toner and carrier mixture, an M toner and carrier mixture, and a Y toner and carrier mixture. These mixtures are generally referred to as two-ingredient type developers. Developing sleeves 14A, 15A, 16A and 17A are respectively received in the developing units 14, 15, 16 and 17, and each is rotatable while carrying the associated developer thereon, In each of the developing units 14–17, the toner and carrier are charged to opposite polarities due to friction; the toner is charged to the negative polarity in the illustrative embodiment.

The toner images of different colors may be sequentially formed on the drum 9 in any desired order. In the following description, the B, C, M and Y toner images are assumed to be formed in this order.

When all the developing units 14–17 are inoperative, i.e., in their stand-by condition, no developers are deposited on any one of the sleeves 14A–17A. On the start of an image forming operation, the color scanner 1 starts reading a B image at a preselected timing and outputs B image data, as stated previously. As a result, a latent image representative of the first image or B image is formed on the drum 9 in accordance with the B image data. Let the latent image derived from the B image data be referred to as a B latent image. This is also true with the other latent images derived from C, M and Y image data.

Before the leading edge of the B latent image arrives at a developing position assigned to the B developing unit 14, the developing sleeve 14A of the unit 14 starts rotating in order to develop the latent image from the leading edge. Consequently, the B developer is deposited on the periphery of the sleeve 14A in rotation and then brought into contact with the surface of the drum 9, so that the B latent image turns out a B toner image. Specifically, the toner of negative polarity is electrostatically transferred from the sleeve 14A to the image portion of the drum 9 where the surface potential has dropped, forming a toner image on the drum 9. For the image transfer, a negative bias voltage is applied to the sleeve 14A. In this manner, the illustrative embodiment effects so-called reversal development.

As soon as the trailing edge of the B latent image moves away from the developing position of the B developing unit 14, the B developer on the sleeve 14A is brought to its inoperative position so as to render the B developing unit 1 inoperative. This is completed at least before the leading edge of the next latent image or C latent image derived from the C image data arrives at the B developing unit 14. To bring the B developer to its inoperative position, the sleeve 14A is rotated in the direction opposite to the direction assigned to development.

The B toner image formed on the drum 1 is electrostatically transferred to an intermediate transfer belt 19 which is a specific form of an intermediate transfer body. The belt 19 is formed of a material having a medium resistance and passed over a drive roller 21, a bias roller 20, a drive roller 35, and other driven rollers. These constituents constitute a single intermediate transfer belt unit in combination. A power source, not shown, applies to the bias roller 20 a bias voltage of polarity opposite to the polarity of the toner deposited on the drum 9, i.e., a positive bias voltage in the illustrative embodiment. The portion of the belt 19 passed over the bias roller 20 contacts the surface of the drum 9. The drive roller 21 driven by a motor, not shown, causes the belt 19 to move in a direction indicated by an arrow in FIG. 1. The drum 9 and belt 19 are caused to move in the same direction, as seen at the position where they contact each other, and at the same linear velocity.

When the B toner image on the drum 9 is brought to a primary transfer region 39 where the drum 9 and belt 19 contact each other, the positive bias voltage applied to the bias roller 20 causes the B toner image to be electrostatically attracted by and transferred to the belt 19 (primary transfer). In this sense, the bias roller 20 plays the role of first electric field forming means for forming a static electric field for the primary transfer between the drum 9 and the belt 19.

The toner left on the drum 9 after the primary transfer of the B toner image is removed by a cleaning unit 10 including a precleaning discharger, not shown, and a cleaning member 10A. The cleaning member 10A is implemented by a brush roller and a cleaning blade. As a result, the surface of the drum 9 is cleaned and prepared for the next image formation.

The primary transfer of the B toner image is followed by the formation of a C toner image. Specifically, the surface of the drum 9 is again discharged by the discharge lamp 11 and then uniformly charged to the negative polarity by the charger 12. The color scanner 1 again starts reading the document 3 at a preselected timing and outputs C image data. A C latent image based on the C image data is formed on the drum 9 by the laser beam.

After the B latent image has moved away from a developing position assigned to the C developing unit 15, but before the leading edge of the C latent image arrives at the unit 15, the developing sleeve 15A starts rotating and causes the C developer to deposit thereon. The C developer develops the C latent image in exactly the same manner as the B developer has developed the B latent image. As soon as the trailing edge of the resulting C toner image moves away form the developing position of the developing unit 15, the developer on the sleeve 15A is rendered inoperative. This is also completed before the leading edge of the next latent image or M latent image arrives at the developing unit 15.

The C toner image is transferred from the drum 9 to the belt 19 over the B toner image existing on the belt 19 by the primary transfer. The C toner left on the drum 9 after the primary transfer of the C toner image is also removed by the cleaning unit C.

The above procedure is also sequentially executed with M image data and Y image data. An M toner image and a Y toner image formed on the drum 9 are sequentially transferred to the belt 19 over the composite image existing on the belt 19. In this manner, the B, C, M and Y toner images are sequentially transferred from the drum 9 to the belt 19 in register with each other, forming a full-color image. The full-color image is transferred from the belt 19 to a recording medium by a transfer roller 23 at a time. The transfer roller 23 is a specific form of an image transferring device.

The recording medium is implemented as a paper P by way of example. Cassettes 31, 32 and 33 each is loaded with a stack of papers P of particular size. A paper P is fed from any one of the cassettes 31–33 selected by the operator to a registration roller pair 26. The registration roller pair 26 once stops the leading edge of the paper P and then starts conveying it toward a secondary transfer region 40 between the belt 19 and the transfer roller 23 such that the leading edge of the paper P meets the leading edge of the full-color image on the belt 19.

While the primary transfer of any toner image from the drum 9 to the belt 19 is under way, a mechanism, not shown, maintains the transfer roller 23 spaced from the belt 19. At the time of the secondary transfer of the full-color image from the belt 19 to the paper P, the above mechanism brings the transfer roller 23 into contact with the belt 19, so that the paper P is passed through the nip between the belt 19 and the roller 23. At this instant, the transfer roller 23 is rotated in the same direction as the belt 19, as seen at the position where the former contacts the latter. In addition, a bias voltage opposite in polarity to the toner, i.e., a positive bias voltage in the illustrative embodiment is applied to the transfer roller 23. Consequently, the full-color or four-color image is electrostatically transferred from the belt 19 to the paper P in the secondary transfer region 40 at a time.

As stated above, the transfer roller 23 applied with a preselected bias voltage constitutes second electric field forming means for forming a static electric field for the secondary transfer of the toner image from the belt 19 to the paper P.

A conveying unit 227 conveys the paper P coming out of the secondary transfer region 40 to a fixing unit 28 including a heat roller 28A and a press roller 28B. As the paper P is passed between the heat roller 28A and the press roller 28B, the toner image is fixed on the paper P by heat and pressure. Finally, the paper P with the fixed toner image is driven out onto a tray 29.

The toner left on the belt 19 after the secondary transfer is removed by a cleaning unit 22 including a cleaning blade 22A. While the primary transfer of any toner image is under way, a mechanism, not shown, maintains the cleaning blade 22A spaced from the belt 19. After the secondary transfer, the above mechanism presses the cleaning blade 22A against the belt 19.

In a repeat copy mode for repeating the above procedure, the operation of the color scanner 1 and the formation of a toner image on the drum 9 begin at a preselected timing after the formation of the last or Y toner image, so that a toner image of first color, i.e., a B toner image can be formed on the second paper P. Specifically, after the secondary transfer of the full-color image from the belt 19 to the first paper P, toner images to be collectively transferred to the second paper P by the secondary transfer are sequentially transferred to the surface of the belt 19 cleaned by the cleaning unit 22. Such a procedure is repeated with a desired number of papers P.

While the above description has concentrated on a full-color mode, the above procedure will be repeated, in a three-color mode or a two-color mode, a number of times corresponding to the desired number of colors and the desired number of copies. In a one-color mode, the developing unit corresponding to a desired color continuously forms toner images on the drum 19 until a desired number of copies have been produced. In this case, the belt 19 is rotated at a constant speed in contact with the drum 9. The cleaning blade 22A of the cleaning unit 22 is also held in contact with the belt 19.

In any one of the above image forming modes, the belt 19 may be continuously rotated in the direction indicated by the arrow. Alternatively, the movement of the belt 19 may be controlled by either a constant speed back-and-forth system or a quick return or back-and-forth system, as follows.

The constant speed back-and-forth system is applicable to a one-color mode for forming, e.g., a black toner image. Let the direction of rotation of the belt 19 indicated by the arrow in FIG. 1 be referred to as a forward direction. Then, when a plurality of one-color toner images are desired, the belt 19 is moved forward at a constant speed even after the primary transfer of the first toner image from the drum 9 to the belt 19. The transfer roller 23 is brought into contact with the belt 19 by the previously mentioned mechanism in synchronism with the movement of the paper P, so that the toner image is transferred from the belt 19 to the paper P. This is repeated to transfer toner images sequentially transferred to the belt 19 to consecutive papers P.

The quick return system is applicable to the image forming mode using two or more colors. After the transfer of the B toner image from the drum 9 to the belt 19, the belt 19 is moved away from the drum 9 and caused to stop its forward movement. At the same time, the belt 19 is quickly returned in the other direction or backward. After the leading edge of the B toner image has moved away from the primary transfer region 39 backward and then moved a preselected additional distance, the belt 19 is caused to stop returning and remain in a stand-by state. Subsequently, when the leading edge of the C toner on the drum 9 arrives at a preselected position short of the primary transfer region 39, the belt 19 is again caused to start moving forward and again brought into contact with the drum 9. The C toner image is transferred from the drum 9 to the belt 19 in accurate register with the B toner image.

After the primary transfer of the fourth color or Y toner image from the drum 9 to the belt 19, the belt 19 is caused to move forward at the same speed without being returned. The transfer roller 23 is brought into contact with the belt 19 in synchronism with the movement of a paper to which the full-color image is to be transferred from the belt 19. As a result, the full-color image is transferred from the belt 19 to the paper.

I evaluated images produced by the image forming apparatus 100 including the drum 9 and belt 19. Experiments showed that a toner image transferred to the belt 19 by the primary transfer is dislocated, deteriorating the quality of the final image. Particularly, when toner images of different colors are transferred to the belt 19 one above the other, as in the apparatus shown in FIG. 1, it is likely that the individual toner images are brought out of register and bring about color differences, thereby degrading the resulting composite image to a critical degree.

The above dislocation of a toner image is ascribable to the following, as determined by extended researches and experiments. In the apparatus 1 shown in FIG. 1, at the time of primary transfer of a toner image from the drum 9 to the belt 19, a bias voltage opposite in polarity to the toner is applied to the bias roller 20 and therefore to the belt 19. As a result, a static electric field is formed between the drum 9 and the belt 19 and produces electrostatic attraction between the drum 9 and the belt 19. The electrostatic attraction is particularly intense in the apparatus 100 using a reversal development scheme, because charges of opposite polarities are respectively deposited on the drum 9 and belt 19.

Figure 4:
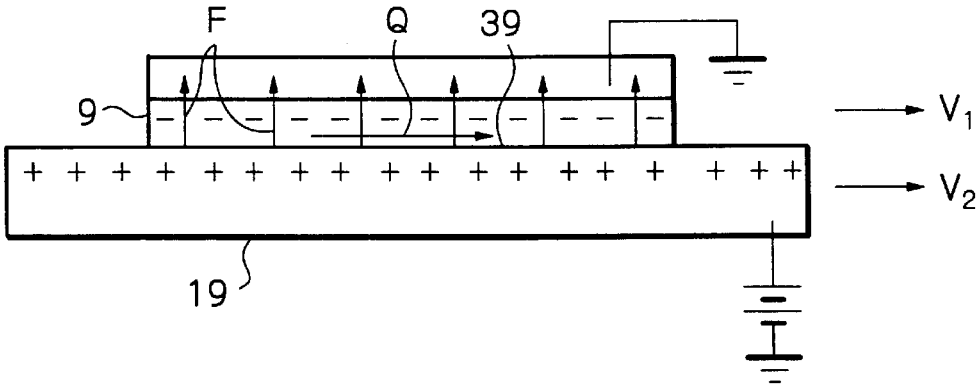
FIG. 4 shows a relation between a photoconductive element and an intermediate transfer body.

FIG. 4 shows a relation between the drum 9 and belt 19. As shown, in the primary transfer region 39, a negative charge and a positive charge are respectively deposited on the drum 9 and belt 19. Consequently, the drum 9 exerts electrostatic attraction on the belt 19, as indicated by a force F.

The drum 9 and belt 19 move in the same direction with the same linear velocity, as seen in the primary transfer region 39, as stated earlier. In practice, however, some difference in linear velocity between the drum 9 and the belt 19 is unavoidable due to some eccentricity of the bias roller 20 and the positional errors of the drum 9 and belt 19 relative to the printer body. Usually, such a difference in linear velocity appears periodically.

As shown in FIG. 4, assume that the surface of the drum 9 and that of the belt 19 tend to move at linear velocities of $V_1$ and $V_2$, respectively, and that $V_1$ is caused to exceed $V_2$. Then, in the primary transfer region 39, the electrostatic attraction acting between the drum 9 and the belt 19 causes the drum 9 to exert a force Q on the belt 19. As a result, the surface of the belt 19 moves at the same linear velocity of the surface of the drum 9. At this instant, stresses ascribable to the force Q are generated in the drum 9 and belt 19. As soon as the stresses increase to a certain degree, the movement of the drum 9 and that of the belt 19 are sharply deviated from each other. Such an occurrence is repeated. Consequently, an image is dislocated in the subscanning direction, i.e., the moving direction of the surface of the belt 19. That is, while the dislocation of an image does not occur so long as the drum 9 and belt 19 move at the same speed because of the electrostatic attraction, it occurs due to the subsequent noticeable difference between the velocity of the drum 9 and that of the belt 19.

It will be seen from the above that if the electrostatic attraction acting between the drum 9 and the belt 19 is reduced or if the surface of the drum 9 and that of the belt 19 are made easier to slip on each other, even a difference between the linear velocity of the drum 9 and that of the belt 19 causes the drum 9 and belt 19 to immediately deviate from each other by a minimum of stroke. As a result, the surface of the drum 9 and that of the belt 19 constantly slip on each other. This prevents the surface of the drum 9 and that of the belt 19 from deviating in movement from each other by a noticeable stroke. As a result, the dislocation of an image, i.e., color which would degrade the image quality, is obviated.

Actually, experimental results show that a toner image of first color (B toner image in the illustrative embodiment) is dislocated more than the others when transferred from the drum 9 to the belt 19 by the primary transfer, and that the dislocation sequentially decreases with the successive toner images. This is presumably accounted for by the following. When a toner image of first color is transferred from the drum 9 to the belt 19, the amount of toner intervening between the drum 9 and the belt 19 is too small to allow them to easily slip on each other. As the primary transfer from the drum 9 to the belt 19 is repeated, the amount of toner intervening between them increases and reduces the area over which the drum 9 and belt 19 directly contact each other, i.e., the influence of the electrostatic attraction. This, coupled with the fact that the toner plays the role of a lubricant, allows the drum 9 and belt 19 to easily slip on each other.

Further, toner images of first color each having a particular area were formed on the drum 9, and each was transferred to the belt 19 by the primary transfer. Also, the deviation between each of the toner images of first color existing on the belt 19 and a toner image of second color transferred to the belt 19 later was estimated. It was found that the deviation between the toner images of first and second colors decreases with an increase in the area of the toner image of first color. This also proves that even during the primary transfer of the toner image of first color, the dislocation of the toner image can be reduced if a substantial amount of toner exists between the drum 9 and the belt 19.

Figure 5:
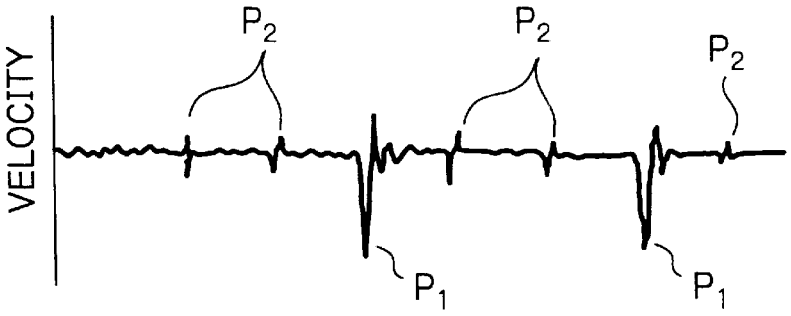
FIG. 5 shows why a toner image is dislocated.

How the velocity of the belt 19 varies will be described with reference to FIG. 5. As shown, at the time of primary transfer of a toner image from the drum 9 to the belt 19, the belt 19 moves at a velocity $P_1$ if only a small amount of toner exists between the drum 9 and the belt 19 or moves at a velocity $P_2$ if a great amount of toner exists therebetween.

In light of the above, in the primary transfer region 39 where a toner image is transferred from the drum 9 to the belt 19, the illustrative embodiment causes toner different from the toner forming the desired toner image to exist in order to promote slippage between the surface of the drum 9 and that of the belt 19 and thereby reduces the dislocation of the toner image. For this purpose, an additional toner image based on additional information different from the desired C, Y. M and B image data output from the image processing unit 30, FIGS. 2 and 3, and implementing the final image is caused to exist in the primary transfer region 39. The additional toner image allows the drum 9 and belt 19 to easily slip on each other and prevents them from being abruptly deviated in movement from each other.

However, the problem is that the additional toner image existing in the primary transfer region 39 would also be transferred to a paper and would disturb the final image on the paper. To solve this problem, in the illustrative embodiment, a number of dot toner images each having a diameter as small as, e.g., 150 $\mu$m to 300 $\mu$m, particularly about 200 $\mu$m, are uniformly distributed on the surface of the drum 9 by dot image forming means which will be described. At the time of the primary transfer from the drum 9 to the belt 19, the above dot toner images are caused to exist in the primary transfer region 39. The density of the dot toner images is selected to be, e.g., three dots to ten dots for a unit area of 1 $cm^2$.

A number of dot toner images existing in the primary transfer region 39, but having no relation to desired image information, prevent a toner image from being noticeably dislocated on the belt 19. Although the dot toner images are also transferred to the image region of the belt 19 and then transferred to a paper, they are too small to be identified by eye. The dot toner images therefore do not deteriorate the quality of the final image at all.

The dot toner images may be formed on the surface of the drum 9 in any one of various ways and then transferred to the belt 19. In the apparatus 100 of the type sequentially transferring toner images of different colors from the drum 9 to the belt 19, it is necessary that a great amount of toner be present in the primary transfer region 39 even at the primary transfer of a toner image of first color so as to prevent the toner image from being dislocated. In this type of apparatus 100, before the transfer of the toner image of first color from the drum 9 to the belt 19, the dot toner images may advantageously be transferred by the bias roller 20 from the drum 9 to the image area of the belt 19 to which the desired toner image will be transferred. At the time of the transfer of toner images of second and successive colors from the drum 9 to the belt 19, a great amount of toner already existing between the drum 9 and the belt 19 successfully prevents them from being dislocated.

As shown in FIG. 2, before image data of first color are input to the writing control unit 34, an additional information generating unit 13 inputs additional information representative of the dot toner images to the control unit 34. The control unit 34 causes, based on the additional information, the LD drive unit 18 to drive the laser 8A, FIG. 1. As a result, a laser beam forms latent images representative of the dot toner images on the surface of the drum 9 uniformly charged by the charger 12. These latent images are developed by toner stored in any one of the developing units 14–17. The resulting dot toner images are transferred by the bias roller 20 from the drum 9 to the image area of the belt 19 to which desired toner images of different colors will be transferred one above the other. Thereafter, the additional information generating unit 13 is deactivated. In this condition, toner images of different colors are sequentially formed on the drum 9 in accordance with image data output from the color scanner 1 or the personal computer 37 while being sequentially transferred to the belt 19 one above the other.

To describe the above construction more generically, an image forming apparatus with an image carrier and an intermediate transfer body includes dot image forming means for forming, before the primary transfer of the first toner image from the image carrier to the intermediate transfer body, a number of scattered fine dot toner images to be transferred to the intermediate transfer body on the image carrier. In FIGS. 1 and 2, the additional information generating unit 13, writing control unit 34 and writing unit 8 including the LD drive unit 18 constitute the dot image forming means in cooperation with a developing device 38.

In the above configuration transferring the dot toner images on the drum 9 before the primary transfer of the first toner image of first color, and transferring the dot toner images to the belt 19, a period of time necessary for image formation is increased by such an extra step. To reduce the image forming time, the dot toner images having no relation to the first toner image of first color may be formed on the drum 9 together with the first toner image and transferred to the belt 19 together by the bias roller 20 to which the bias voltage is applied. In this case, as shown in FIG. 3 specifically, data representative of the dot toner images and output from the additional information generating unit 13 are added to the image data of first color output from the image processing unit 30. The two different kinds of data are input to the writing control unit 34. Consequently, a laser beam issuing from the laser 8A forms a latent image representative of the first toner image of first color and a latent image representative of the dot toner images on the drum 9 at the same time. These latent images are simultaneously developed by a designated one of the developing units to turn out a composite toner image. The composite toner image is transferred from the drum 9 to the belt 19 by the bias roller 20.

To describe the above construction more generically, an image forming apparatus with an image carrier and an intermediate transfer body includes dot image forming means for forming a number of scattered fine dot toner images on the image carrier over a toner image initially formed on the image carrier. In FIGS. 1 and 3, the additional information generating unit 13, writing control unit 34 and writing unit 8 including the LD drive unit 18 also constitute the dot image forming means in cooperation with the developing device 38.

In any one of the above configurations, the dot toner images based on the additional information may be formed by toner of any desired color. Experimental results show that Y toner, among the others, renders the dot toner images so inconspicuous, the user cannot recognize them on a paper at all. Y toner therefore further enhances the quality of the final image. In the illustrative embodiment, the Y developing unit 17 is used to form the first toner image of first color on the drum 9.

The dot toner images may be distributed over the surface of the drum 1 or that of the belt 19 either regularly or irregularly. It is preferable that the dot toner images be arranged in a pattern representative of information unique to the image forming apparatus, e.g., a serial number, a manufacturer's name or a date of production. For example, when counterfeit notes are produced by the image forming apparatus, the apparatus can be identified later on the basis of the dot toner images formed on the notes. This successfully obviates the forgery of notes or the like.

It is to be noted that the experiments described in relation to the illustrative embodiment were conducted under the following specific conditions. A photoconductive element was implemented by OPC (Organic PhotoConductor). An intermediate transfer belt was formed of carbon-dispersed ETFE (Ethylene TetraFluoro Ethylene) and had a volume resistivity of $10^{10}$ Ωcm and a surface resistivity of $10^{9}$ Ω. A transfer roller was implemented as a hydrin rubber roller covered with a PFE tube and had a volume resistivity of $10^{9}$ Ωcm. Toner was implemented by polyol as a main resin; polyol was colored by carbon for black or colored by pigments for cyan, magenta, and yellow. Silica was added to the toner as a fluidity enhancing material. Each developer had a toner content of 1 wt % to 6 wt % while toner caused a charge of −15 C/g to −25 C/g to deposit thereon. The surface potential of the photoconductive element was −80 V to −130 V in an image or −500 V to −700 V in a background. A processing speed was selected to be 180 mm/sec. A bias voltage for primary transfer was 1,200 V for the first color, 1,300 V for the second color, 1,400 V for the third color, or 1,500 V for the fourth color. The bias voltage for secondary transfer was 1,300 V.

In summary, it will be seen that the present invention provides an image forming apparatus having various unprecedented advantages, as enumerated below.

(1) At the time of primary transfer of a toner image from an image carrier to an intermediate transfer body, a great amount of toner exists between the image carrier and the intermediate transfer body and allows them to easily slip on each other. This prevents an image from being dislocated on the intermediate transfer body. In addition, fine dot toner images added are not conspicuous when transferred to a recording medium, insuring high image quality.

(2) At the time of primary transfer of a toner image of first color formed first on the image carrier to the intermediate transfer body, a great amount of toner exists between the image carrier and the intermediate transfer body and allows them to easily slip on each other. This also prevents an image from being dislocated on the intermediate transfer body and therefore insures accurate register of toner images of different colors. Again, the fine dot toner images added are not conspicuous when transferred to a recording medium, insuring high image quality.

(3) The dot toner images are transferred from the image carrier to the intermediate transfer body together with the toner of first color formed first on the image carrier. Therefore, a great amount of toner exists between the image carrier and the intermediate transfer body at the time of the primary transfer of the first toner image, allowing the image carrier and intermediate transfer body to easily slip on each other. This is also successful to achieve the above advantages (2).

(4) The dot toner images are particularly inconspicuous on the recording medium when formed by yellow toner.

(5) The dot toner images are usable as information unique to an image forming apparatus.

Various modifications will become possible for those skilled in the art after receiving the teachings of the present disclosure without departing from the scope thereof.

What is claimed is:

1. An image forming apparatus comprising:

an image carrier for successively forming component toner images of different colors on a surface thereof;

an intermediate transfer body to a surface of which the component toner images are successively transferred from the surface of said image carrier by primary transfer;

first electric field forming means for forming between said image carrier and said intermediate transfer body a static electric field for effecting the primary transfer of the toner image;

second electric field forming means for forming between said intermediate transfer body and a recording medium a static electric field for transferring the toner image from the surface of said intermediate transfer body to the recording medium; and dot image forming means for forming a number of scattered dot toner images unrelated to desired image information in a form of fine dots on the surface of said image carrier, the number of scattered dot toner images being formed from toner of one of the different colors, and said dot toner images being transferred from the surface of said image carrier to an image area of the surface of said intermediate transfer body prior to a transfer of a first of the first component toner images from the image carrier to the intermediate transfer body to act as a lubricant to prevent an excessive electrostatic force between aid image carrier and said intermediate transfer body.

2. An apparatus as claimed in claim 1, wherein said dot toner images are arranged in a pattern representative of information unique to said apparatus.

3. An apparatus as claimed in claim 1, wherein said dot toner images are formed by yellow toner.

4. An apparatus as claimed in claim 3, wherein said dot toner images are arranged in a pattern representative of information unique to said apparatus.

5. An image forming apparatus comprising:

an image carrier for sequentially forming component toner images of different colors on a surface thereof;

an intermediate transfer body to a surface of which the component toner images are sequentially transferred from said image carrier one above the other by primary transfer;

first electric field forming means for forming between said image carrier and said intermediate transfer body a static electric field for effecting the primary transfer of the toner images;

second electric field forming means for forming between said intermediate transfer body and a recording medium a static electric field for collectively transferring the toner images from the surface of said intermediate transfer body to the recording medium; and dot image forming means for forming, before the primary transfer of a first toner image to the surface of said intermediate transfer body, a number of scattered dot toner images unrelated to desired image information in a form of fine dots on the surface of said image carrier, the number of scattered dot toner images being formed from toner of one of the different colors, and said dot toner images being transferred from the surface of said image carrier n to an image area of the surface of said intermediate transfer body to which said first toner image will be transferred prior to a transfer of a first of the component toner images from the image carrier to the intermediate transfer body to act as a lubricant to prevent an excessive electrostatic force between said image carrier and said intermediate transfer body.

6. An apparatus as claimed in claim 5, wherein said dot toner images are arranged in a pattern representative of information unique to said apparatus.

7. An apparatus as claimed in claim 5, wherein said dot toner images are formed by yellow toner.

8. An apparatus as claimed in claim 7, wherein said dot toner images are arranged in a pattern representative of information unique to said apparatus.

9. An image forming apparatus comprising:

an image carrier for successively forming component toner images of different colors on a surface thereof;

an intermediate transfer body to a surface of which the component toner images are successively transferred from the surface of said image carrier by primary transfer;

first electric field forming means for forming between said image carrier and said intermediate transfer body a static electric field for effecting the primary transfer of the toner image;

second electric field forming means for forming between said intermediate transfer body and a recording medium a static electric field for transferring the toner image from the surface of said intermediate transfer body to the recording medium; and dot image forming means for forming a number of scattered dot toner images in a form of fine dots on the surface of said image carrier, said dot toner images each having a diameter between 150 $\mu$m to 300 $\mu$m and being transferred from the surface of said image carrier to an image area of the surface prior to a transfer of a first of the component toner images from the image carrier to the intermediate transfer body.

10. An image forming apparatus comprising:

an image carrier for sequentially forming component toner images of different colors on a surface thereof;

an intermediate transfer body to a surface of which the component toner images are sequentially transferred from said image carrier one above the other by primary transfer;

first electric field forming means for forming between said image carrier and said intermediate transfer body a static electric field for effecting the primary transfer of the toner images;

second electric field forming means for forming between said intermediate transfer body and a recording medium a static electric field for collectively transferring the toner images from the surface of said intermediate transfer body to the recording medium; and dot image forming means for forming, before the primary transfer of a first toner image to the surface of said intermediate transfer body, a number of scattered dot toner images in a form of fine dots on the surface of said image carrier, said dot toner images each having a diameter between 150 $\mu$m to 300 $\mu$m and being transferred from the surface of said image carrier to an image area of the surface of said intermediate transfer body to which said first toner image will be transferred prior to a transfer of a first of the component toner images from the image carrier to the intermediate transfer body.

11. An image forming apparatus comprising:

an image carrier for successively forming component toner images of different colors on a surface thereof;

an intermediate transfer body to a surface of which the component toner images are successively transferred from the surface of said image carrier by primary transfer;

first electric field forming means for forming between said image carrier and said intermediate transfer body a static electric field for effecting the primary transfer of the toner image;

second electric field forming means for forming between said intermediate transfer body and a recording medium a static electric field for transferring the toner image from the surface of said intermediate transfer body to the recording medium; and dot image forming means for forming a number of scattered dot toner images in a form of fine dots on the surface of said image carrier with a density of three to ten dots for a unit area of 1 $cm^2$, said dot toner images being transferred from the surface of said image carrier to an image area of the surface prior to a transfer of a first of the component toner images from the image carrier to the intermediate transfer body.

12. An image forming apparatus comprising:

an image carrier for sequentially forming component toner images of different colors on a surface thereof;

an intermediate transfer body to a surface of which the component toner images are sequentially transferred from said image carrier one above the other by primary transfer;

first electric field forming means for forming between said image carrier and said intermediate transfer body a static electric field for effecting the primary transfer of the toner images;

second electric field forming means for forming between said intermediate transfer body and a recording medium a static electric field for collectively transferring the toner images from the surface of said intermediate transfer body to the recording medium; and dot image forming means for forming, before the primary transfer of a first toner image to the surface of said intermediate transfer body, a number of scattered dot toner images in a form of fine dots on the surface of said image carrier with a density of three to ten dots for a unit area of 1 $cm^2$, said dot toner images being transferred from the surface of said image carrier to an image area of the surface of said intermediate transfer body to which said first toner image will be transferred prior to a transfer of a first of the component toner images from the image carrier to the intermediate transfer body.

* * * * *